US008661612B2

(12) United States Patent
Brunnström et al.

(10) Patent No.: US 8,661,612 B2
(45) Date of Patent: Mar. 4, 2014

(54) CIRCULAR LIQUID WIPER DEVICE FOR A FLOOR CLEANING MACHINE

(75) Inventors: Ludvig Brunnström, Åsa (SE); Patrik Andreasson, Barcelona (ES)

(73) Assignee: Qleeno AB, Göteborg (SE)

( * ) Notice: Subject to any disclaimer, the term of this patent is extended or adjusted under 35 U.S.C. 154(b) by 0 days.

(21) Appl. No.: 13/579,325

(22) PCT Filed: Feb. 14, 2011

(86) PCT No.: PCT/SE2011/050159

§ 371 (c)(1),
(2), (4) Date: Aug. 16, 2012

(87) PCT Pub. No.: WO2011/102786

PCT Pub. Date: Aug. 25, 2011

(65) Prior Publication Data

US 2012/0311806 A1 Dec. 13, 2012

(30) Foreign Application Priority Data

Feb. 17, 2010 (SE) ..... 1050151

(51) Int. Cl.
*A47L 7/00* (2006.01)

(52) U.S. Cl.
USPC ..... 15/401; 15/322

(58) Field of Classification Search
USPC ..... 15/320–322, 401, 402

IPC ..... A47L 7/00
See application file for complete search history.

(56) References Cited

U.S. PATENT DOCUMENTS 5,706,549 A 1/1998 Legatt et al.

FOREIGN PATENT DOCUMENTS

GB 2459086 A 10/2009
WO 2007/129973 A1 11/2007

OTHER PUBLICATIONS

Sweden Patent Office,Int'l Search Report in PCT/SE2011/050159, May 11, 2011.

*Primary Examiner* — David Redding
(74) *Attorney, Agent, or Firm* — Piedmont Intellectual Property

(57) ABSTRACT

The invention relates to a liquid wiper device formed of a circular obstacle and intended for a floor cleaning machine that operates with liquid and has a scrubbing-brush that is rotatably driven around a vertical shaft by a motor and arranged and intended for the scrubbing of floors and similar surfaces. According to the invention, the device is formed of ring pieces that are interconnectable into a ring shape and have wiper strips carried thereby. The wiper strips have a thickened upper fastening end portion while the remaining part of the wiper strips has essentially a plate shape. The wiper strips have essentially a T-shaped cross-sectional profile, said ring pieces having a number of recesses distributed along the length extension thereof, and the wiper strips are received in and retained by the same.

11 Claims, 6 Drawing Sheets

Figure 1:
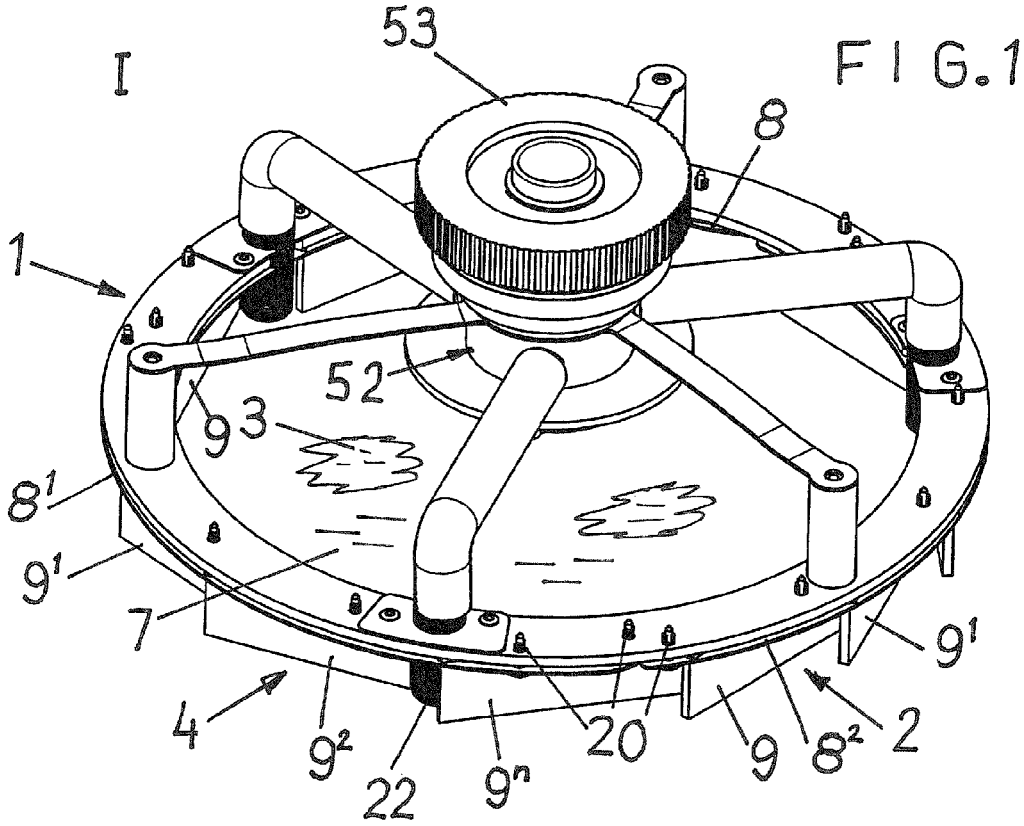

FIG.3
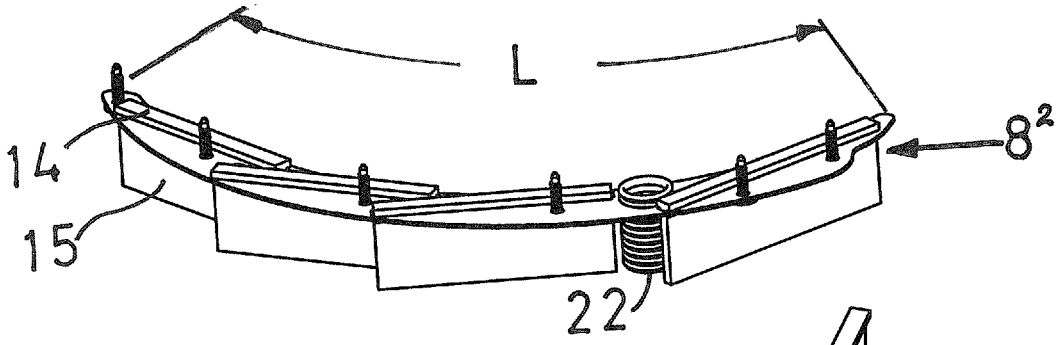
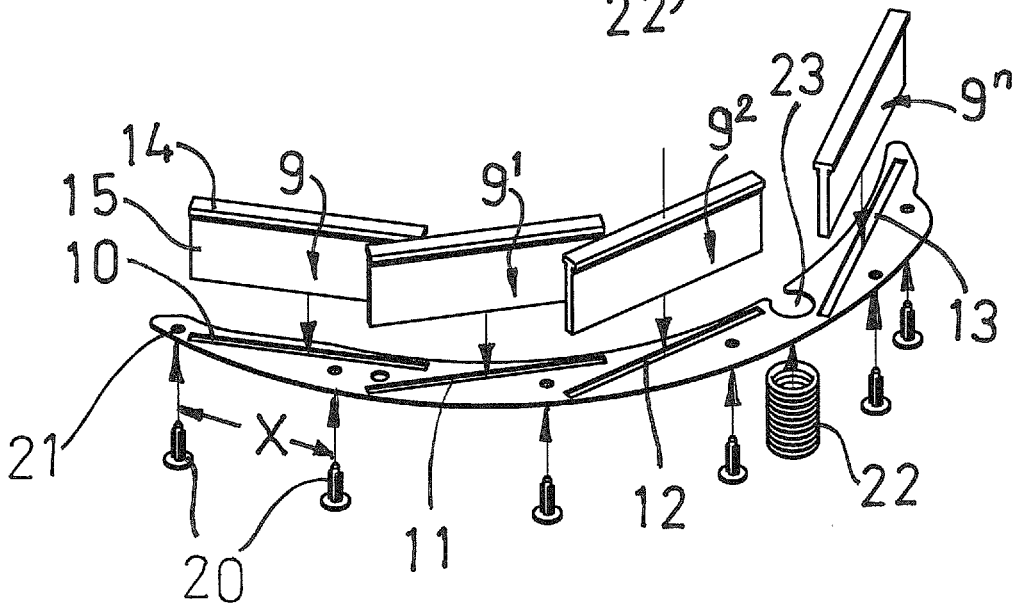
FIG.4

CIRCULAR LIQUID WIPER DEVICE FOR A FLOOR CLEANING MACHINE

The present invention relates to a device for a suction protection formed of a circular obstacle and intended for a floor clean machine that operates with liquid and has a scrubbing-brush that is rotatably driven around a vertical shaft by a motor and arranged and intended for the scrubbing of floors and similar surfaces.

There are problems in floor clean machines in that suction protections are worn and have to be changed and replaced with new ones. If only some part of the known suction protections formed in ring shape is worn, still the entire ring with the suction protection has to be discarded and replaced with a new ring.

The attachment and retention of said suction protection in the machine are also desirable to be effectable in a simple but still efficient way. By, for instance, SE 529 307 C2, examples are shown of a known ring-shaped suction protection in a handheld floor clean machine.

U.S. Pat. No. 5,706,549 concerns a floor clean machine with an appurtenant suction protection for liquid. The suction protection is formed of a plurality of wiper blades (128) that comprise a respective stiff base plate (130) by the upwardly projecting fastening studs (140, 142) of which the wiper blades (128) are snapped on in a circular ring (88). Between said wiper blades (128), nozzles (154) are also possible to snap on to said ring (88). Also said nozzles (154) have a similar shape and function as the adjacent wiper blades (128).

When exchanging wiper blades (128), the entire unit that these consist of is discarded, i.e., the integrated flexible material (146) and the firm fastening material (130). Among other things, the recycling of the different materials is made more difficult, and it also becomes a substantial disadvantage to need to change also the fastening part (130) when only the wiper blade is worn out and need to be changed and replaced with a new one.

The wiper blades (12) according to the applicant's own SE 529 868 C2 have an L-shaped cross-sectional profile. This shape, it has turned out, makes that the blades (12) are pressed radially by the superposed ring part (10*a*) thereof, since no resisting upper clampable part is on the blade's side opposite its centre axis. The problem with oblique blades is intended to be solved by instead arranging the blade with an even cross-sectional profile, so that the main part is clamped evenly.

Therefore, the main object of the present invention is primarily to solve, among others, the problems mentioned above in an efficient and cost-effective way.

Said object is achieved by means of a device according to the present invention that essentially is characterized in that the suction protection is formed of ring pieces that are interconnectable into a ring shape and have wiper strips carried thereby, that the wiper strips have a thickened upper fastening end portion while the remaining part of the wiper strips has essentially a plate shape, that the wiper strips have essentially a T-shaped cross-sectional profile, said ring pieces having a number of recesses distributed along the length extension thereof, and that the wiper strips are received in and retained by the same.

Figure 1A:
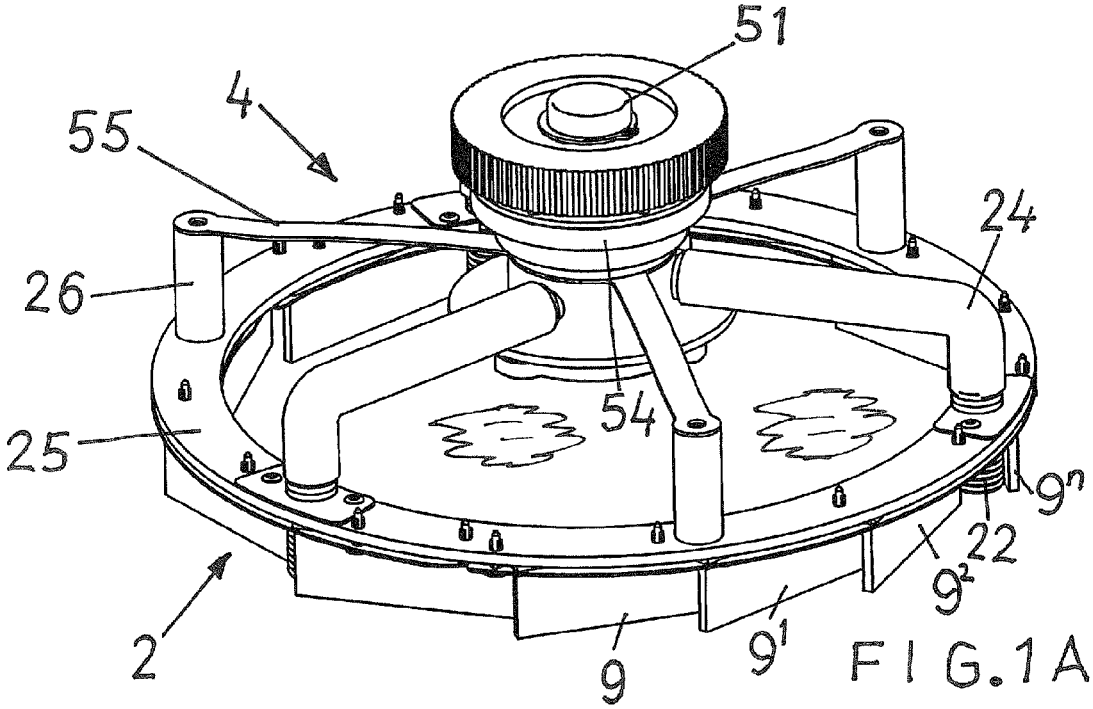
Figure 2:
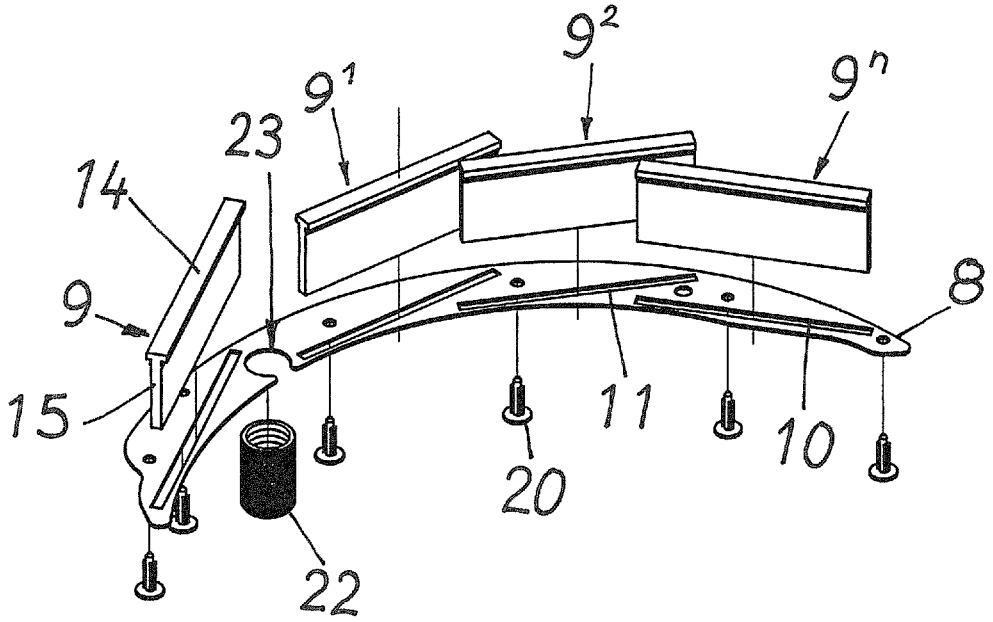
Figure 2:
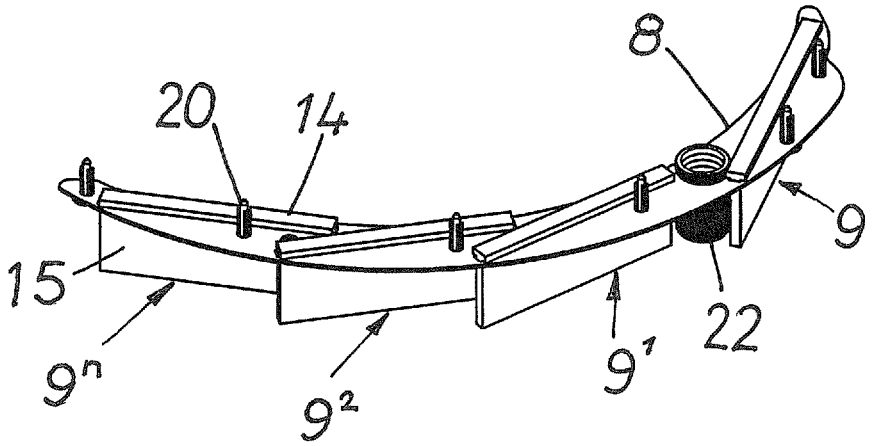
Figure 2A:
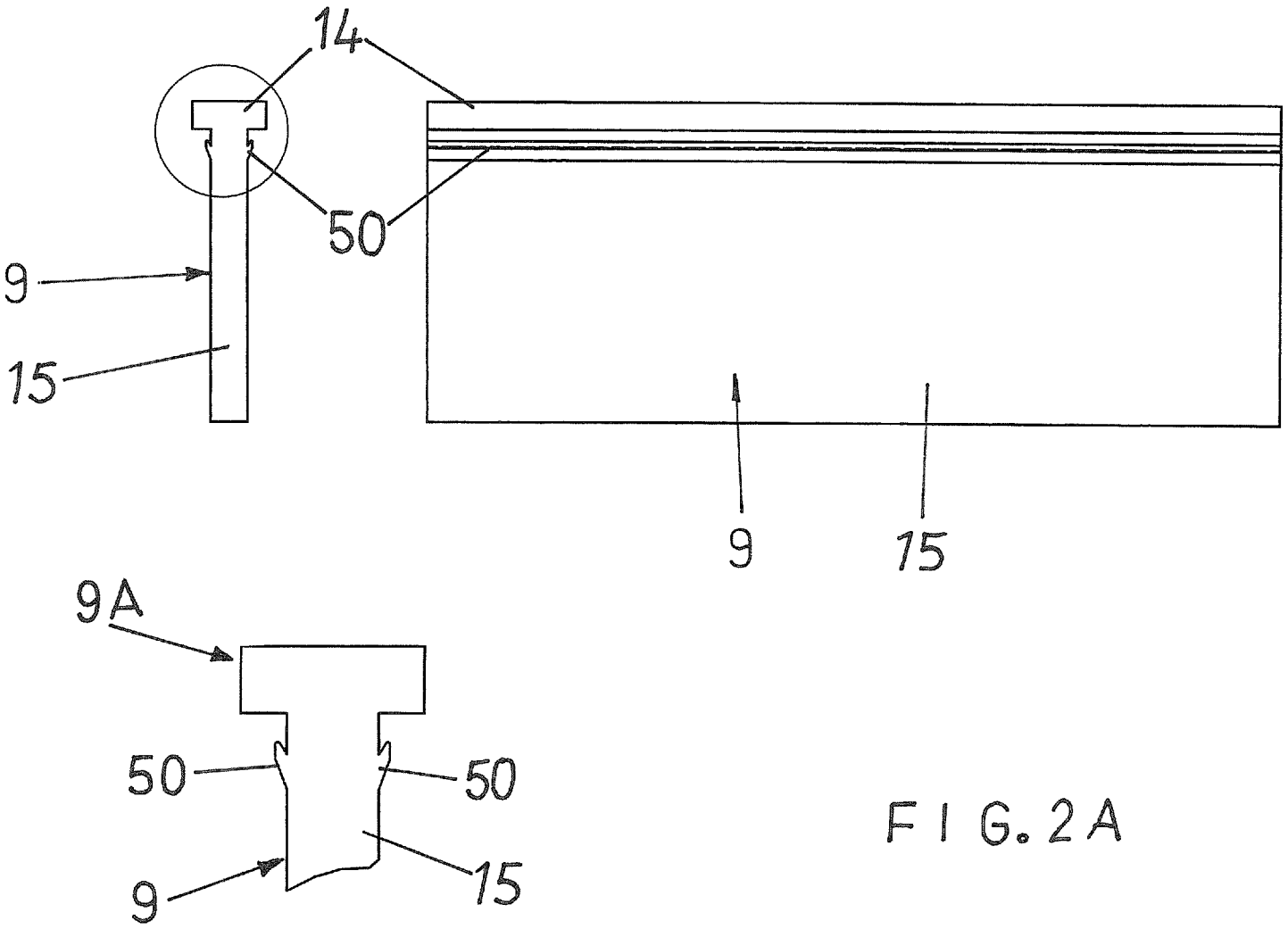
Figure 5:
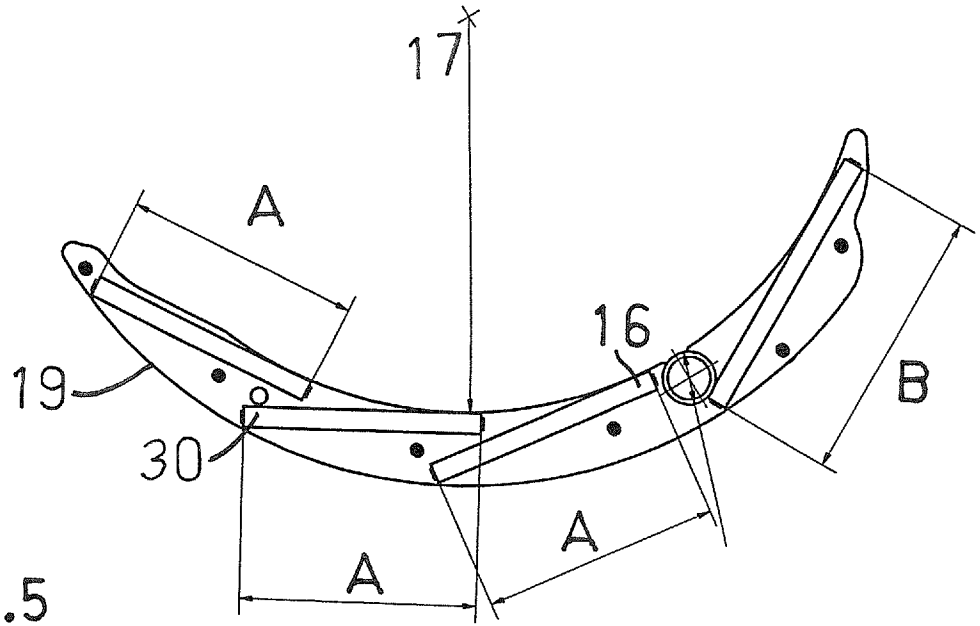
Figure 6:
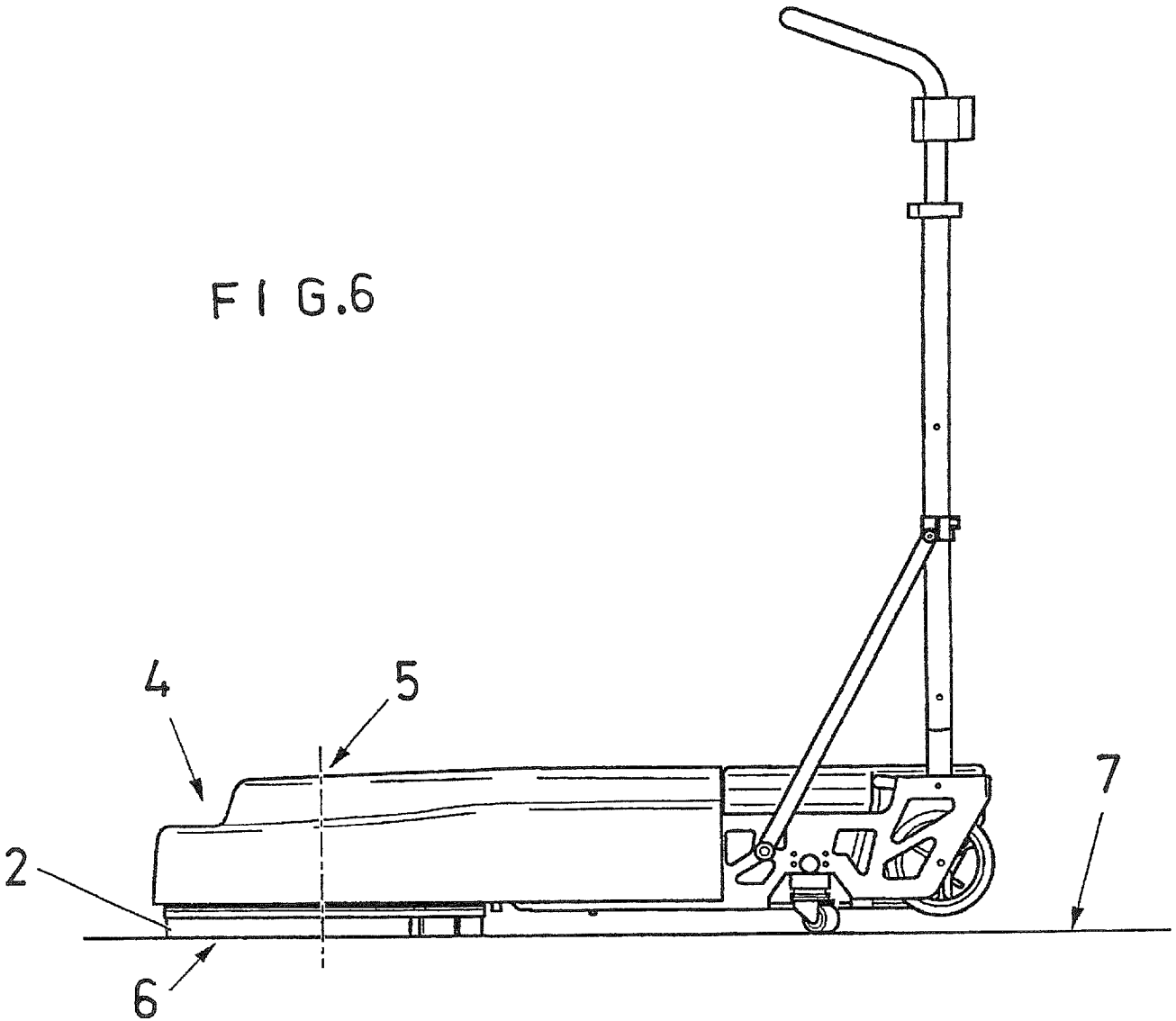

The invention is described below in the form of a preferred embodiment example, reference being made to the accompanying drawings, in which:

FIG. 1 shows in perspective obliquely from above a suction protection formed according to the present invention in an assembled state and in a mounted position on a floor clean machine, FIG. 1A shows the suction protection and the machine in perspective obliquely from the side, FIG. 2 shows the invention as individual parts as seen obliquely from above, FIG. 2A shows a wiper strip from the side, in profile as well as the upper part of the same, FIG. 3 shows the invention as seen obliquely from above and from outside, FIG. 4 shows an exploded view of the invention in a mounting stage, FIG. 5 shows the invention straight from below, and FIG. 6 shows a side view of a floor clean machine provided with a suction protection.

A device 1 according to the present invention, which is intended to be applied to a suction protection 2 formed of a circular obstacle and intended for a floor clean machine 4 that operates with liquid 3, for instance of the type that is manoeuvred by hand, and has a scrubbing-brush 6 that is rotatably driven around a vertical shaft 5 by a motor and intended for the scrubbing of floors 7 and similar surfaces, as well as provided with a suction device for the suction of dirty scrub liquid 3, is formed of a partible suction protection 2. More precisely, said suction protection 2 is formed of a plurality of ring pieces 8, $\mathbf{8}^1$, $\mathbf{8}^2$ that are interconnectable into a ring shape and have wiper strips 9, $\mathbf{9}^1$, $\mathbf{9}^2$, $\mathbf{9}^n$ carried thereby. Said wiper strips consist of rubber, plastic or another suitable preferably flexible material that does not risk damaging the subjacent floor 7 in the cleaning stage of the machine 4.

Said ring pieces 8, $\mathbf{8}^1$, $\mathbf{8}^2$, which in the shown embodiment example are three in number but the number of which of may vary both downward and upward, have a suitable number of recesses 10-13 distributed along the length extension L thereof. According to the invention, the respective wiper strips 9-9$^n$ are received in the same and retained therein, namely with a strip 9-9$^n$ in each recess 10-13.

Retention of the strips 9-9$^n$ is provided by the same having a thickened upper fastening end portion 14 each, while the remaining part 15 of the wiper strips has essentially a plate shape that preferably is straight.

The wiper strips 9-9$^n$ have laterally extending projections 50, preferably in the form of barbs at a distance from the upper end 9A of the wiper strips, so that said barbs are arranged to, at least, obstruct pulling up of the wiper strips 9-9$^n$ in the active fastening position in the ring pieces 8-8$^2$.

The wiper strips 9-9$^n$, which have essentially a T-shaped cross-sectional profile, are, with the respective part 15, essentially congruent with the circumferential shape of the recesses 10-13 and have all the same length A or different lengths A and B, respectively. Said wiper strips 9-9$^n$ are arranged inclined to the circumferential shape of the ring by the recesses 10-13 in the ring pieces 8-8$^2$ being arranged to, for instance, extend tangentially in relation to the length extension L of the ring pieces and preferably overlapping each other with the respective inner portion 16 thereof arranged at a common circular arc 17 and with the respective outer portion 30 thereof arranged in an outwardly angled position at a common outer circular arc 19.

Said separate ring pieces 8-8$^2$ have in turn fastening means 20 in order to thereby be detachably anchorable to a said floor clean machine 4, preferably projecting rivets or bolts 20 or other stud-shaped fastening members that are arranged to be projected from the ring pieces 8-8$^2$ or that are detachably arranged to be received in openings 21 situated in the ring pieces 8-8$^2$, distributed at mutual distances X along the same.

In addition, a sleeve-shaped hose part 22 is arranged connectable with the respective ring piece 8-8$^2$ via a mating congruent recess 23, and that is attachable in the recess 23 for the connection to a suction hose 24, end-to-end with this suction hose 24. Upon suction, the hose ends are pressed against each other. By the negative pressure formed, they keep it tight in the joints.

A said floor clean machine 4 has a ring-shaped reception part 25 having a number of fastening studs 26 distributed along the circumference of said part. By means of said reception part 25, the ring pieces 8-8$^2$ are arranged to be detachably attachable to the machine 4 by the fact that thereat, in the fastening position I, the intermediate and upper thickened portion 14, respectively, of the wiper strips 9-9$''$ are received in the appurtenant recesses 10-13 in the ring pieces 8-8$^2$ and thereby be clampable between the appurtenant wiper strip 9-9$''$ and said compressed reception ring 25. The barbs 50 are arranged to, at least, obstruct pulling up of the wiper strips 9-9$''$ in the active fastening position in the ring pieces 8-8$^2$.

A suction device of a type previously known per se may be arranged on the machine 4 to suck up scrub liquid that is accumulated efficiently inside said wiper strips 9-9$''$ that work as suction protection strips and, as wipers, collect the liquid and retain the liquid inside the suction protection 2 until the machine has sucked it up and transported it, via the lines 22, 24, to the intended reception place, e.g., a tank intended for the receipt of dirty cleaning liquid.

The function of the invention is described in more detail and principally as follows.

The machine 4 shown in FIGS. 1 and 1A, on which the brush for the scrubbing is not mounted and shown, has the suction protection 2 mounted and ready. Said wiper strips 9-9$''$ are intended to all the time make sure that the water used for scrubbing does not get outside the periphery of the formed ring but is wiped together and sucked up with a suction pump (not shown). On the machine 4, there is shown the three suction places where the water 3 is sucked up from the substratum by the pump via the downwardly projecting hose parts 22 and further up through connecting suction hoses 24 of, e.g., dental kind, and further out through a hollow central shaft 51 that also works for driving the suction ring 2 and the brush 6.

In the drawing, there is shown how the three angle hoses 24 converge into the hollow rotatable shaft 51 in a spindle housing 52, which also works as support for the brush 7, which is to be mounted inside the mounted ring. On the spindle housing 52, there is a belt wheel 53 for driving the shaft assembly and the suction ring as well as a bearing mounting 54 for the shaft assembly as well as for fixation to the chassis of the cleaning machine.

The fastening studs 26 form spacer pins between mounted suction protections working as a suction ring 2 and interconnectable leaf springs 55 starting from the centre of the machine. The function of the bolted leaf springs 55 is to hold the suction ring 2 in place as well as to allow transferring the rotating motion of the shaft to the suction ring 2.

It is also shown how the upper ring 25 forms support for the divided ring pieces 8-8$^2$ and the spacers 26 for the leaf springs 55.

Finally, it should be mentioned that said ring 25 and ring pieces 8-8$^2$ are assembled by means of shown rivets 20 of plastic or by means of other suitable fastening members.

The function and nature of the invention are clearly seen from the above mentioned, but the invention is naturally not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A device for a suction protection formed of a circular obstacle and configured for a floor cleaning machine that operates with liquid, that has a scrubbing-brush that is rotatably driven around a vertical shaft by a motor and arranged for scrubbing a floor, comprising:

suction protection formed of ring pieces that are interconnectable into a ring shape and have wiper strips carried thereby, wherein the wiper strips have thickened upper fastening end portions, remaining portions of the wiper strips are substantially plate-shaped, the wiper strips have substantially T-shaped cross-sectional profiles, the ring pieces have a number of recesses distributed along length extensions thereof, and the wiper strips are configured to be received in and retained by the recesses.

2. The device of claim 1, where the recesses extend tangentially in relation to the length extensions of the ring pieces.

3. The device of claim 2, wherein most of the recesses are arranged to extend overlapping each other with the inner portion thereof arranged at a common circular arc, and with the respective outer portion thereof in an outwardly angled position arranged at a common outer circular arc.

4. The device of claim 1, wherein the cross-sectional profiles of the wiper strips and circumferential shapes of the recesses are substantially congruent to each other.

5. The device of claim 4, where the recesses extend tangentially in relation to the length extensions of the ring pieces.

6. The device of claim 5, wherein most of the recesses are arranged to extend overlapping each other with the inner portion thereof arranged at a common circular arc, and with the respective outer portion thereof in an outwardly angled position arranged at a common outer circular arc.

7. The device of claim 1, wherein the ring pieces include fasteners configured for detachably anchoring to the floor cleaning machine.

8. The device of claim 7, wherein fastening members project from the ring pieces or are detachably received in openings in the ring pieces.

9. The device of claim 7, wherein the ring pieces are configured for detachable attachment with a ring-shaped reception part of the floor cleaning machine with intermediate upper thickened portions of the suction protection strips received in the appurtenant recesses and configured for clamping between the appurtenant suction protection strip and the reception ring.

10. The device of claim 1, wherein the ring pieces have a recesses for detachable retention of a hose part for the connection to a suction hose.

11. The device of claim 1, wherein the wiper strips have laterally extending projections at a distance from upper end of the wiper strips such that the laterally extending projections obstruct pulling up of the wiper strips in an active fastening position in the ring pieces.

* * * * *